US009342044B2

(12) United States Patent
Naitoh et al.

(10) Patent No.: US 9,342,044 B2
(45) Date of Patent: May 17, 2016

(54) FIXING DEVICE AND IMAGE FORMING APPARATUS AND METHOD OF ASSEMBLING THE FIXING DEVICE

(71) Applicants: Yutaka Naitoh, Hyogo (JP); Tomohiko Fujii, Hyogo (JP); Minoru Toyoda, Hyogo (JP); Hitoshi Fujiwara, Osaka (JP); Tomoya Adachi, Hyogo (JP); Yasuharu Kawarasaki, Osaka (JP); Tetsu Morino, Osaka (JP); Isamu Kubo, Kanagawa (JP); Yoshiharu Takahashi, Osaka (JP)

(72) Inventors: Yutaka Naitoh, Hyogo (JP); Tomohiko Fujii, Hyogo (JP); Minoru Toyoda, Hyogo (JP); Hitoshi Fujiwara, Osaka (JP); Tomoya Adachi, Hyogo (JP); Yasuharu Kawarasaki, Osaka (JP); Tetsu Morino, Osaka (JP); Isamu Kubo, Kanagawa (JP); Yoshiharu Takahashi, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 11 days.

(21) Appl. No.: 13/953,966

(22) Filed: Jul. 30, 2013

(65) Prior Publication Data

US 2014/0056625 A1 Feb. 27, 2014

(30) Foreign Application Priority Data

Aug. 21, 2012 (JP) ..... 2012-182377

(51) Int. Cl.
*G03G 15/20* (2006.01)
*G03G 21/16* (2006.01)

(52) U.S. Cl.
CPC ..... *G03G 21/1685* (2013.01); *G03G 15/2053* (2013.01); *G03G 2215/2035* (2013.01)

(58) Field of Classification Search
CPC ..... B29C 65/58; B29C 66/4322; G03G 2215/2035; G03G 15/2017
USPC ..... 399/329
See application file for complete search history.

(56) References Cited

U.S. PATENT DOCUMENTS

| | | | | |
|---|---|---|---|---|
| 1,952,381 | A * | 3/1934 | Lunn | 138/165 |
| 6,122,478 | A * | 9/2000 | Hirst | 399/330 |
| 2008/0175633 | A1 | 7/2008 | Shinshi | |
| 2010/0092220 | A1 | 4/2010 | Hasegawa et al. | |
| 2012/0177422 | A1* | 7/2012 | Nanno et al. | 399/329 |
| 2012/0275834 | A1* | 11/2012 | Naitoh et al. | 399/329 |
| 2013/0064586 | A1 | 3/2013 | Adachi et al. | |

FOREIGN PATENT DOCUMENTS

| | | |
|---|---|---|
| JP | 2008-158482 | 7/2008 |
| JP | 2010-096782 | 4/2010 |

* cited by examiner

*Primary Examiner* — David Gray
*Assistant Examiner* — Michael Harrison
(74) *Attorney, Agent, or Firm* — Harness, Dickey & Pierce, PLC

(57) ABSTRACT

A fixing unit includes an endless belt accommodating a heat source inside a loop formed by the endless belt, a rotary pressing member rotating in contact with the endless belt in a pressure contact section, and a heat transfer member secured to a side plate within the loop of the endless belt to support and heat the endless belt with heat conducted from the heat source. The heat transfer member has an opening opposite the rotary pressing member. A securing member is disposed in the opening of the heat transfer member in pressure contact with the rotary pressing member via the endless belt. The heat transfer member and the securing member collectively include a pair of latching parts to firmly connect the heat transfer member and the securing member with each other when one of the latching parts is fitted to the other one of the latching parts.

24 Claims, 5 Drawing Sheets

FIXING DEVICE AND IMAGE FORMING APPARATUS AND METHOD OF ASSEMBLING THE FIXING DEVICE

CROSS-REFERENCE TO RELATED APPLICATION

This patent application is based on and claims priority pursuant to 35 U.S.C. §119 to Japanese Patent Application No. 2012-182377, filed on Aug. 21, 2012 in the Japan Patent Office, the entire disclosure of which is hereby incorporated by reference herein.

BACKGROUND

1. Technical Field

The present invention relates to a fixing unit and an image forming apparatus with the fixing unit. More specifically, the present invention relates to a fixing unit installed in an image forming apparatus, such as a copier, a facsimile, a printer, etc., employing an electrophotography system.

2. Related Art

At present, various types of image forming apparatuses, such as copiers, facsimiles, printers, etc., employing an electrophotography system have been developed and are widely known. The image forming process employed in the image forming apparatuses is realized in such a manner that an electrostatic latent image is initially formed on a surface of a photosensitive drum serving as an image carrier. The electrostatic latent image on the photosensitive drum is subsequently developed and rendered visible by toner, etc., serving as developer. The thus developed image is subsequently transferred and borne on a recording medium (hereinafter sometimes referred to as a paper sheet, a recording sheet, or a transfer sheet) by a transfer unit. The toner image thus developed and borne on the recording medium is subsequently fixed by a fixing unit using pressure and heat, etc. In the fixing unit, a pressing member and a fixing member are positioned while contacting each other and forming a fixing nip (i.e., a nip) between the pressing member and the fixing member. Such a pressing member and the fixing member are composed of either a pair of opposed rollers or belts or a combination of rollers and/or belts. For example, among various types, a roller type-fixing unit forms the fixing nip by pressing the fixing roller against the pressing roller, with the fixing roller containing a heat source, such as a halogen heater, etc. Thus, when a recording medium bearing an unfixed toner image on its surface is conveyed through the nip formed between a pair of rotary members (e.g., a fixing roller and a pressing roller) currently rotated, heated, and pressed against each other at the time, the roller type fixing unit subsequently applies the heat and pressure generated between the fixing roller and the pressing roller to the recording medium to melt and fix the unfixed toner image borne on the recording medium.

Recently, in accordance with a growing demand for saving energy and shortening a wait time required for heating a fixing unit (i.e., a warm-up time, a time to first print or the like), a so-called on-demand type fixing unit that decreases its own heat capacity by employing an endless belt, such as a belt unit, a thin film, etc., instead of a roller (i.e., a fixing roller), thereby upgrading efficiency of heat transfer to a recording medium while dramatically shortening the waiting time is widely adopted. As this kind of the fixing unit, there is, for example, a conventional system like that disclosed in JP-2008-158482-A, which includes a belt unit and a securing member (e.g., an opposite member) that borders and slides on an inner circumferential surface of the belt unit while being pressed against a rotary pressing member (e.g., a pressing roller) through the belt unit to form a nip between the belt unit and the rotary pressing member. Such a conventional system fixes a toner image on a recording medium by conveying the recording medium into the fixing nip as already known. Such a fixing unit of the system is generally provided with a heat transfer member (e.g., a heater) disposed either close to or contacting the inner circumferential surface of the belt at a position other than the nip. The heat transfer member thus additionally serves as a belt guide sometimes in this point of view.

In this type of the fixing unit, movement of the belt at inlet and outlet sides of the nip in a conveying direction of the recording medium is technically important, especially, in view of transportation of the recording medium. For example, when a positioning relation between the securing member and the heat transfer member deviates from a desired target due to deformation of the heat transfer member or the like, the following problems likely to occur.

First, when the heat transfer member protrudes at the inlet side of the nip toward the rotary pressing member from a nip formation surface specifying a nip, entry of the recording medium to the nip worsens, possibly wrinkling the recording medium. In addition, a trailing end of the recording medium flutters, so that an image on the recording medium may be rubbed by surrounding members surrounding the nip.

By contrast, when the heat transfer member protrudes at the outlet side of the nip toward the rotary pressing member from the nip formation surface, the belt excessively winds around the rotary pressing member at a larger angle than is usual, thereby seeming to increasing a nip width (i.e., an apparent nip width) as a result. Consequently, problems, such as deterioration of image quality due to excessive heating of the toner image, damage to or cuts on the belt caused when a recording medium separator contacts the belt at downstream of the nip, etc., are likely to occur.

Conversely, when the heat transfer member is extremely indented at the outlet side of the nip from the nip formation surface, a gap between the belt and a separator that separates the recording medium from the belt excessively increases more than expected, so that the recording medium likely enters the gap and becomes unable to be ejected from the gap.

In this respect, not to cause the heat transfer member (i.e., a heater) to deform and thus deal with such problems, JP-2010-96782-A discloses a fixing unit in which a heat transfer member has an opening to arrange a securing member that clamps and fixes the opening not to widen with a pair of stays. With such a conventional technology of JP-2010-96782-A, since deformation of the heat transfer member can be almost prevented by fixing the opening of the heat transfer member, movement of the belt can be stabilized actually. However, in the conventional technology of JP-2010-96782-A, since the opening is secured by pinching the opening with the pair of stays, the number of parts and that of assembly steps significantly increase, thereby again, increasing heat capacity of component parts, accordingly. As a result, it is difficult to both shorten the heating time and save energy as well. Further, since the pair of stays is provided in the opening, displacement (i.e., layout) and shape of load bearing members are limited. Especially, a length of the load-bearing unit (i.e., a reinforcing unit) that bears the load is limited in a loading direction of the load. Specifically, such limitation is generally disadvantageous when bearing a relatively larger nip load.

SUMMARY

Accordingly, one aspect of the present invention provides a novel fixing unit for fixing an unfixed toner image onto a recording medium by applying a pressing and heating process to the unfixed toner image. Such a fixing unit comprises an endless belt accommodating a heat source inside a loop formed by the endless belt, a rotary pressing member rotating in contact with the endless belt (in a pressure contact section), and a heat transfer member secured (to a side plate) within the loop of the endless belt to support and heat the endless belt with heat conducted from the heat source. The heat transfer member has an opening opposite the rotary pressing member. A securing member is disposed in the opening of the heat transfer member in pressure contact with the rotary pressing member via the endless belt. The heat transfer member and the securing member collectively include a pair of latching parts to firmly connect the heat transfer member and the securing member with each other when one of the latching parts is fitted to the other one of the latching parts.

In another aspect of the present invention, an image forming apparatus to form a toner image on a recording medium comprises a toner image forming unit to form a toner image on a recording medium and a fixing unit. Such a fixing unit includes an endless belt accommodating a heat source inside a loop formed by the endless belt, a rotary pressing member rotating in contact with the endless belt (in a pressure contact section), and a heat transfer member secured (to a side plate) within the loop of the endless belt to support and heat the endless belt with heat conducted from the heat source. The heat transfer member has an opening opposite the rotary pressing member. A securing member is disposed in the opening of the heat transfer member in pressure contact with the rotary pressing member via the endless belt. The heat transfer member and the securing member collectively include a pair of latching parts to firmly connect the heat transfer member and the securing member with each other when one of the latching parts is fitted to the other one of the latching parts.

In another aspect of the present invention, to assemble a fixing unit composed of an endless belt accommodating a heat source inside a loop thereof, a rotary pressing member rotating in contact with the endless belt in a pressure contact section, a heat transfer member having an opening and secured to a side plate within the loop of the endless belt to support and heat the endless belt with heat conducted from the heat source, and a securing member disposed in the opening of the heat transfer member in pressure contact with the rotary pressing member via the endless belt, a method of assembling the fixing unit includes the steps of inserting the securing member into the heat transfer member in an axial direction of the heat transfer member from one end of the heat transfer member, displacing the securing member toward the opening of the heat transfer member to contact the rotary pressing member via the endless belt within the heat transfer member, fitting one or more first latching parts provided in one of the heat transfer member and the securing member to a corresponding one or more second latching parts provided in the other one of the heat transfer member and the securing member, and firmly connecting the heat transfer member and the securing member with each other by confirming completion of connection of the first and second latching parts by the sense of touch or hearing.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
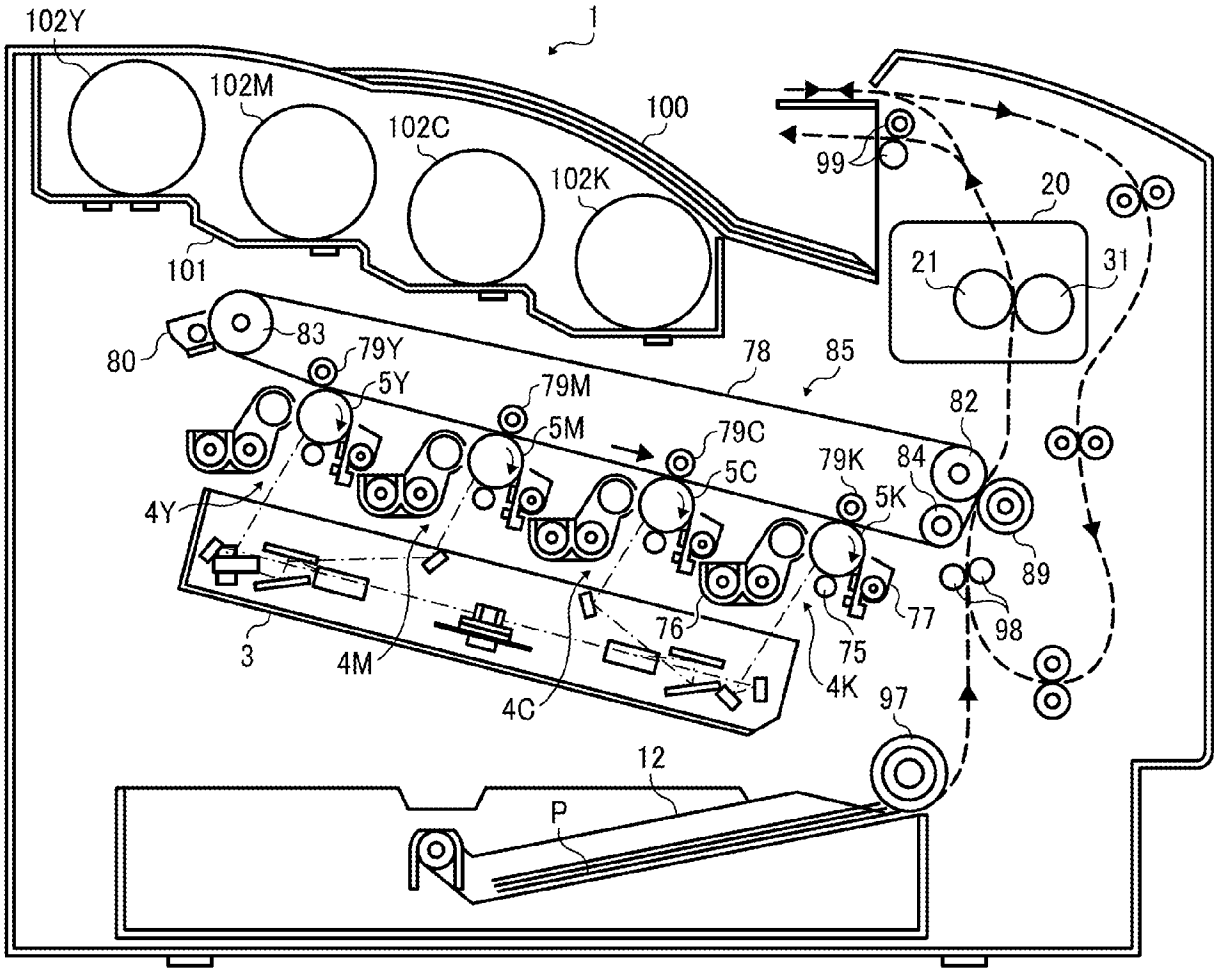
FIG. 1 is a cross-sectional view illustrating an exemplary image forming apparatus according to one embodiment of the present invention.

Referring now to the drawings, wherein like reference numerals designate identical or corresponding parts throughout the several views thereof and in particular to FIG. 1, an overall configuration of an image forming apparatus according to one embodiment of the present invention is described.

As shown there, an image forming apparatus according to one embodiment the present invention is a tandem type color printer and an overview of an internal configuration and operation of the tandem type color printer is initially described herein below.

A bottle container unit 101 is provided above a main body of the image forming apparatus 1. Four toner bottles 102Y, 102M, 102C, and 102K are detachably attached to the bottle container unit 101 corresponding to four component colors (i.e., yellow, magenta, cyan, and black) so that these toner bottles 102Y, 102M, 102C, and 102K are freely replaceable.

Below the bottle container unit 101, an intermediate transfer unit 85 is provided. An intermediate transfer belt 78 is included in the intermediate transfer unit 85. Multiple image forming units 4Y, 4M, 4C, and 4K forming component images corresponding to respective component colors (i.e., yellow, magenta, cyan, and black) are positioned side by side almost opposite the intermediate transfer belt 78 of the intermediate transfer unit 85.

In the image forming units 4Y, 4M, 4C, and 4K, multiple photoconductive drums 5Y, 5M, 5C, and 5K are disposed, respectively.

In addition, around each of the photoconductive drums 5Y, 5M, 5C, and 5K, a charging unit 75, a developing unit 76, a cleaning unit 77, and a charge removing unit (not shown in the drawing), etc., are provided.

Further, an image forming process (i.e. a charging process, an exposing process, a developing process, a transfer process, and a cleaning process) is held on each of the photoconductive drums 5Y, 5M, 5C, and 5K, and respective component color images are thereby formed on the photoconductive drums 5Y, 5M, 5C, and 5K.

Specifically, to execute the processes, the photoconductive drums 5Y, 5M, 5C, and 5K are driven clockwise as shown in FIG. 1 by a driving motor or motors, not shown in the drawing. Then, each of surfaces of the photoconductive drums 5Y, 5M, 5C, and 5K is uniformly charged during the charging process at a position of each of the charging unit 75.

Then, the surfaces of the respective photoconductive drums 5Y, 5M, 5C, and 5K reach irradiation spots in which respective laser beams are emitted from the exposing device 3. Then, an exposure scanning process is applied to each of those so that electrostatic latent images are formed at these points corresponding to the component colors during the exposing process.

Then, the surfaces of the respective photoconductive drums 5Y, 5M, 5C, and 5K reach prescribed positions opposite the developing unit 76. The electrostatic latent images are subsequently developed at these prescribed positions, so that toner images for respective component colors are formed during the developing process.

Then, the surfaces of the respective photoconductive drums 5Y, 5M, 5C, and 5K reach prescribed positions opposite both the intermediate transfer belt 78 and the respective primary transfer bias rollers 79Y, 79M, 79C, and 79K. The toner images borne on the photoconductive drums 5Y, 5M, 5C, and 5K are subsequently transferred onto the intermediate transfer belt 78 at these prescribed positions during the primary transfer process.

At this moment, not transferred toner particles generally slightly remains as residual toner particles on each of the photoconductive drums 5Y, 5M, 5C, and 5K.

However, the surfaces of the respective photoconductive drums 5Y, 5M, 5C, and 5K subsequently reach prescribed positions opposite the cleaning units 77 equipped with cleaning blades, and the not transferred toner particles remaining on the photoconductive drums 5Y, 5M, 5C, and 5K are mechanically reclaimed at the prescribed positions by the cleaning blades in the respective cleaning unit 77 during the cleaning process.

Finally, the surfaces of the respective photoconductive drums 5Y, 5M, 5C, and 5K reach prescribed positions opposite the charge removing units, not shown, and residual potentials remaining on the photoconductive drums 5Y, 5M, 5C, and 5K are subsequently removed at these prescribed positions, respectively. Thus, a series of the image forming processes to be executed on the respective photoreceptor drums 5Y, 5M, 5C, and 5K is completed in this way.

Then, through the process of developing, each component color toner image formed on each of the photoconductor drums 5Y, 5M, 5C, and 5K is transferred and overlaid (i.e., superimposed) on the intermediate transfer belt 78. In this way, a full-color image is ultimately formed on the intermediate transfer belt 78.

Here, the intermediate transfer unit 85 may be composed of the above-described intermediate transfer belt 78, four primary transfer bias rollers 79Y, 79M, 79C, and 79K, a secondary transfer backup roller 82, a cleaning backup roller 83, a tension roller 84, and an intermediate transfer cleaning unit 80, etc.

The intermediate transfer belt 78 is stretched and supported by these three rollers 82 to 84 and is endlessly moved only by the secondary transfer backup roller 82, for example, as it rotates in a direction as indicated by arrow in FIG. 1. The intermediate transfer belt 78 is sandwiched in between these four primary transfer bias rollers 79Y, 79M, 79C, and 79K and the photoconductive drums 5Y, 5M, 5C, and 5K, respectively, to form the primary transfer nips, respectively.

Further, a transfer bias having a polarity reverse to that of toner is applied to each of the primary transfer bias rollers 79Y, 79M, 79C, and 79K. Further, the intermediate transfer belt 78 runs and sequentially passes through the primary transfer nips of the respective primary transfer bias rollers 79Y, 79M, 79C, and 79K in the direction as indicated by arrow.

Thus, each of the component color toner images borne on the photoconductive drums 5Y, 5M, 5C, and 5K is primarily transferred and all of them are superimposed on the intermediate transfer belt 78, repeatedly. Then, the intermediate transfer belt 78 with the thus transferred and superimposed component color toner images on its surface reach a prescribed opposing position opposite the secondary transfer roller 89.

At this position, the intermediate transfer belt 78 is sandwiched in between the secondary transfer backup roller 82 and the secondary transfer roller 89 collectively forming the secondary transfer nip. Further, the four-component color toner image formed and borne on the intermediate transfer belt 78 in this way is subsequently transferred onto the recording medium P timely conveyed up to the prescribed position of the secondary transfer nip.

At this moment, some of toner not transferred onto the recording medium P remains on the intermediate transfer belt 78 again. However, the intermediate transfer belt 78 reaches a prescribed position opposite the intermediate transfer cleaning unit 80 after that. The not transferred toner remaining on the intermediate transfer belt 78 is subsequently collected at the prescribed position from the intermediate transfer belt 78.

In this way, a series of the transfer process to be executed on the intermediate transfer belt 78 is completed. Here, the recording medium P conveyed up to the secondary transfer nip is one that is transported from a sheet feeding unit 12 disposed at a lower section in the image forming apparatus main body 1 through a sheet feed roller 97 and a pair of registration rollers 98.

Specifically, the sheet feeding unit 12 accommodates a stack of transfer sheets of the recording media P, etc. Accordingly, when the sheet feed roller 97 is driven and rotated counter-clockwise in FIG. 1, the topmost recording medium P is fed toward a gap between the pair of registration rollers 98.

The recording medium P transported up to the pair of registration rollers 98 temporarily stops at a roller nip position defined by the pair of registration rollers 98 that temporarily stops its operation at the time. Then, the pair of registration rollers 98 is driven and rotated again synchronizing with the full-color image borne on the intermediate transfer belt 78 and conveys the recording medium P towards the secondary transfer nip.

Thus, the desired color image is ultimately transferred onto the recording medium P. After that, the recording medium P with the full-color image transferred at the secondary transfer nip is further conveyed up to the fixing unit 20 located at a prescribed position.

Then, at this position of the fixing unit 20, the full-color image transferred onto a front surface of the recording medium P is fused onto the front surface of the recording medium P as the pressure and the heat are provided by the fixing belt 21 and the pressing roller 31, respectively. The recording medium P is subsequently ejected outside an image forming apparatus through a gap between a pair of sheet exit rollers 99 ultimately.

The recording medium P ejected by the pair of sheet exit rollers 99 is stacked sequentially on a stacking unit 100 as an output of the image. In this way, a series of image forming process is completed in the image forming apparatus.

Now, an exemplary construction and operation of a fixing unit 20 provided in an image forming apparatus 1 is described herein below with reference to FIG. 2, in which a schematic cross-sectional view of one example of the fixing unit 20 is illustrated.

The fixing unit 20 as a fixing unit according to this embodiment includes an endless belt (e.g., the fixing belt 21) accommodating an internal heat source (e.g., the heater 25) and a rotary pressing member (e.g., the pressing roller 31) capable of rotating in contact with the endless belt. The fixing unit fixes an unfixed toner image borne on a recording medium P onto the recording medium P by providing heat and pressure to the recording medium P at a pressure contact section (e.g., the nip) formed between the rotary pressing member and the endless belt. The fixing unit 20 includes a heat transfer member (e.g., the heat transfer member 22) secured on a side of an inner circumference of the belt to support the belt. Such a heat transfer member includes an opening (i.e., the opening 22*c* shown in FIG. 3) at a prescribed position opposed to the rotary pressing member in order to heat the belt with heat conducted from the heat source. The fixing unit (i.e., the fixing unit 20) also includes a securing member (e.g., the securing member 26) attached to the opening of the heat transfer member and pressed against the rotary pressing member via the belt. The heat transfer member and the securing member collectively have a unit of connectors (e.g., a square hole 22*b*and a protrusion 26*b*, both shown in FIG. 3) capable of fitting to each other so that the heat transfer member and the securing member can be firmly connected with each other.

Figure 2:
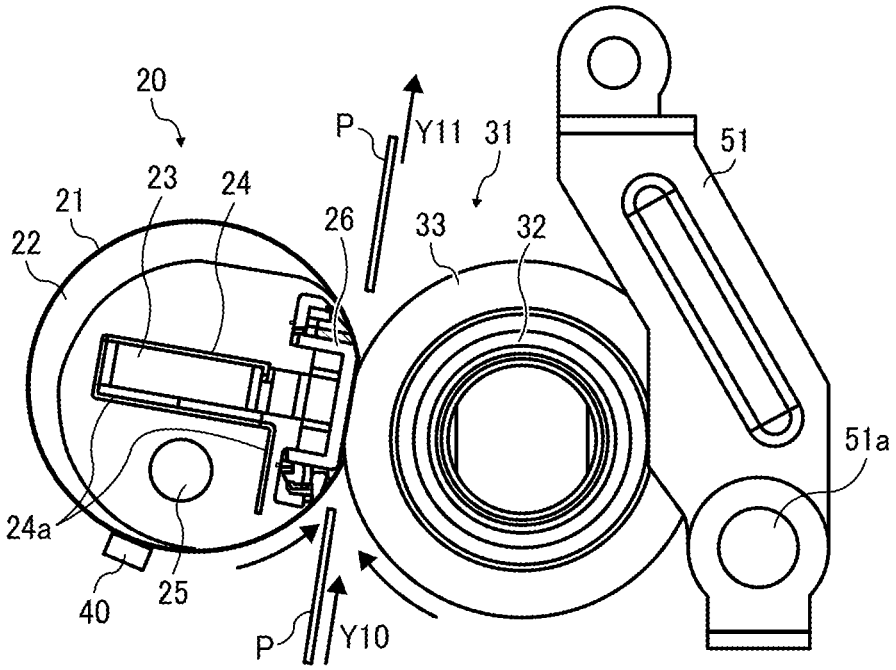
FIG. 2 is a cross-sectional view illustrating an exemplary configuration of a fixing unit according to one embodiment of the present invention.

Further, as shown in FIG. 2, the fixing unit 20 may be composed of a fixing belt 21 as the belt, a securing member 26, a heat transfer member 22, a reinforcing member 23, a reflector 24, a heater (i.e., a heat source) 25, a pressing roller 31 as the rotary pressing member, a temperature sensor 40, and a pressing lever 51 or the like.

Here, the fixing belt 21 is thin and endless having flexibility and rotates (i.e., travels) in a direction as indicated by arrow in the drawing (e.g. counterclockwise). The fixing belt 21 is composed of a substrate layer, an elastic layer, and a mold releasing layer stacked sequentially from its inner circumference side having a total thickness of less than about 1 mm. The substrate layer of the fixing belt 21 has a layer thickness of from about 30 μm to about 100 μm and is made of metal, such as nickel, stainless steel, etc., or resin, such as polyimide, etc.

The elastic layer of the fixing belt 21 has a layer thickness of from about 100 μm to about 300 μm and is made of rubber, such as silicone rubber, foamed silicone, fluorine rubber, etc. Since formation of fine unevenness on a surface of the fixing belt 21 in the nip is almost prevented by providing such an elastic layer, heat is evenly conducted to the toner image borne on the recording medium P thereby capable of almost suppressing occurrence of an image like an orange peel skin.

The mold releasing layer of the fixing belt 21 has a layer thickness of from about 10 μm to about 50 μm, and is made of material, such as PFA (tetrafluoroethylene-perfluoroalkyl vinyl ether copolymer), PTFE (polytetrafluoroethylene), polyimide, polyether imide, PES (polyether sulphide), etc. By providing this mold-releasing layer, mold releasing performance (i.e., peeling off performance) separating from toner T (i.e., a toner image) can be ensured.

Further, a diameter of the fixing belt 21 is set to from about 15 mm to about 120 mm. In particular, in this embodiment of the present invention, the diameter of the fixing belt 21 is set to about 30 mm.

The pressing roller 31 serving as the rotary pressing member bordering the outer circumferential surface of the fixing belt 21 at the nip of the fixing belt 21 has a diameter of from about 30 mm to about 40 mm, and is formed from a hollow metal core 32 and an elastic layer 33 overlying the hollow metal core 32.

The elastic layer 33 of the pressing roller 31 is made of material, such as foam silicone, silicone rubber, fluorine rubber, etc. Here, a thin mold-releasing layer made of material, such as PFA, PTFE, etc., can be provided on a front surface of the elastic layer 33. The pressing roller 31 presses against the fixing belt 21 and collectively forms a desired nip between the pressing roller 31 and the fixing belt 21.

The securing member 26 is made of heat-resistant resin, such as PPS (polyphenylene sulfide), PAI (polyamide imide), PI (polyimide), LCP (liquid crystal polymer), etc. Here, as shown in FIG. 2, a shape of a cross section of the securing member 26 forming the nip is planar as one example. However, a concaved shape or another shape continuously changing from plane to concaved states can also be preferably employed by the securing member 26 to form the nip.

With this, the recording medium P can be sent out from the nip almost following such a curvature formed on the pressing roller 31. Accordingly, occurrence of a problem in that the recording medium P adheres and does not separate from the fixing belt 21 after the fixing process can be almost suppressed.

When the nip becomes almost in parallel to an image plane of the recording medium P by appropriately employing a nip shape, wrinkles can be almost prevented from appearing on the recording medium P. Further, by approximating the nip shape of the cross section to a concaved shape, sticking tightness between the fixing belt 21 and the recording medium P can be upgraded. Further, since the curvature of the fixing belt 21 grows at an outlet side of the nip, the recording medium P ejected from the nip can readily separate from the fixing belt 21.

The heat transfer member 22 is a pipe state member having a wall thickness of less than about 0.2 mm. As material of the heat transfer member 22, a metal heat conductor (i.e., metal having thermal conductivity), such as aluminum, iron, stainless steel, etc., can be employed. By setting a wall thickness of the heat transfer member 22 to less than about 0.2 mm, efficiency of heating the fixing belt 21 can be upgraded.

Further, the heat transfer member 22 is arranged almost to contact or close to the inner circumferential surface of the fixing belt 21 at a prescribed position other than the nip. At the nip (of the heat transfer member 22), an opening 22*c* having a pair of bending portions 22*a* bending inwardly (at its edges) is provided in the heat transfer member 22 as described later more in detail with reference to FIG. 3. Here, a gap A formed between the heat transfer member 22 and the fixing belt 21 (e.g., a gap except for the nip position) is preferably set to be greater than about 0 mm and less than about 1 mm (i.e., 0 mm<A≤1 mm) at a room temperature.

With this, a problem in that a sliding area, in which the heat transfer member 22 borders and slides on the fixing belt 21, increases and accordingly accelerates wear of the fixing belt 21 can be minimized. In addition, a problem in that the heat transfer member 22 and the fixing belt 21 are excessively distanced from each other and thereby deteriorating efficiency of heating the fixing belt 21 can be almost prevented as well.

Since a circular state of the flexible fixing belt 21 is maintained by some degree by approximating the heat transfer member 22 to the fixing belt 21, damage or degradation of the flexible fixing belt 21 possibly caused by deformation of the flexible fixing belt 21 can be likely reduced as well.

Further, to lower a sliding resistance caused between the heat transfer member 22 and the fixing belt 21, a sliding contact surface of the heat transfer member 22 can be made of material having a low friction coefficient. Otherwise, a front surface layer made of material containing fluorine can be formed on the surface of the inner circumference of the fixing belt 21 as well. Here, as shown in FIG. 2, the cross-sectional shape of the heat transfer member 22 is almost a circular state. However, the cross-section of the heat transfer member 22 can be shaped in a polygon state as well.

Further, the securing member 26 and the heat transfer member 22 are disposed at prescribed positions, respectively, as illustrated in FIG. 2. However, a positional relation between a nip formation surface 26*d* of the securing member 26 and vicinities of the nip entrances 22*d* (described later in detail with reference to FIG. 3) of the heat transfer member 22 is especially important in view of driving stability of the fixing belt 21 and conveyance performance of the recording medium P. Thus, a prescribed positioning device is needed and employed as described later more in detail.

Such a heat transfer member 22 is secured and supported by a pair of side plates, not shown, provided in the fixing unit 20 at its widthwise ends, respectively. The heat transfer member 22 is heated by radiant heat (e.g. radiant light) radiated from the heater 25 to heat the fixing belt 21. The heater 25 is configured by one of a carbon heater and a halogen heater or the like.

That is, the heater 25 directly heats the heat transfer member 22. Whereas, the fixing belt 21 is subsequently heated by the heater 25 indirectly via the heat transfer member 22.

Here, output of the heater 25 is controlled based on a result of surface temperature detection executed by a temperature sensor 40 arranged opposite the surface of the fixing belt 21. Thus, by controlling the output of the heater 25, temperature of the fixing belt 21 (i.e., fusing temperature) can be set to a desired level.

In this way, the fixing belt 21 is not only partially or locally heated but also almost globally heated by the heat transfer member 22 in the circumferential direction of the fixing belt 21 in the fixing system 20. Accordingly, even when the image forming apparatus is speeded up, the fixing belt 21 is heated sufficiently thereby capable of almost preventing occurrence of defective fixing.

Further, a reinforcing member 23 is settled on a side of an inner circumferential surface of the fixing belt 21 to reinforce and support the securing member 26 that forms a nip. Such a reinforcing member 23 is fixed and supported by a pair of side plates, not shown, provided in the fixing unit 20 at its widthwise ends, respectively.

Since the reinforcing member 23 engages with the pressing roller 31 through the securing member 26 and the fixing belt 21, a problem in that the securing member 26 receives pressure from the pressing roller 31 and is thereby heavily distorted at the nip can be minimized. To satisfy such a function of it, the reinforcing member 23 is preferably made of prescribed metal material, such as stainless steel, ferroalloy, etc., having relatively high mechanical strength.

Further, when the heater 25 is a heat source that employs a heating system using radiant heat, such as a halogen heater, etc., a thermal insulation member can be disposed on surfaces 24*a* of the reflector 24 opposite the heater 25. Otherwise, a BA (Bright Annealing) process or a specular polishing process can be applied to the surface of the reflector 24 opposite the heater 25 as well. In such a situation, since the radiant heat radiated from the heater 25 toward the reinforcing member 23 (i.e., heat provided to the reinforcing member 23 to heat the reinforcing member 23) is either insulated or reflected and used to heat the heat transfer member 22, efficiency of heating the fixing belt 21 (i.e., the heat transfer member 22) can be further upgraded.

Further, a prescribed gear is attached to the pressing roller 31 to mesh with a driving gear provided in a driving mechanism, not shown, so that the pressing roller 31 can be driven in a direction as indicated by arrow in FIG. 2 (i.e., clockwise). Further, the pressing roller 31 is supported by a pair of side plates, not shown, provided in the fixing unit 20 at its widthwise ends through bearings, respectively, to be able to freely rotate around the bearings. Further, a heat source, such as a halogen heater, etc., can be disposed again inside the pressing roller 31.

Further, when the elastic layer 33 of the pressing roller 31 is made of sponge-like material, such as foam silicone, etc., pressure applied to the nip can be likely reduced. Thus, possibly generated deflection of the securing member 26 can be likely reduced. In addition, since thermal insulation properties of the pressing roller 31 are enhanced and heat of the fixing belt 21 becomes rarely conducted to the pressing roller 31, efficiency of heating the fixing belt 21 can be upgraded as well.

Further, the diameter of the fixing belt 21 is almost equivalent to that of the pressing roller 31 as one example as shown in FIG. 2. However, the diameter of the fixing belt 21 can be smaller than that of the pressing roller 31. In such a situation, since curvature of the fixing belt 21 becomes smaller than that of the pressing roller 31 in the nip, the recording medium P exiting from the nip becomes readily separated from the fixing belt 21.

Further, the diameter of the fixing belt 21 can be larger than that of the pressing roller 31 by contrast. However, regardless of a magnitude relation between respective diameters of the fixing belt 21 and the pressing roller 31, pressure of the pressing roller 31 is controlled not to operate on the heat transfer member 22 in every situation.

Further, the fixing unit 20 includes the pressing lever 51 serving as an engaging and disengaging mechanism that engages and disengages the pressing roller 31 with the fixing belt 21. The pressing lever 51 is supported again by a pair of side plates, not shown, provided in the fixing unit 20 around a supporting shaft 51*a* attached to its one end to be able to freely rotate around the supporting shaft 51*a*.

A central portion of the pressing lever 51 borders (contacts) a bearing attached to the pressing roller 31. Such a bearing is held in an oblong hole, not shown, formed on a side plate, not shown again, to be able to displace (in a prescribed direction) therein. Further, a prescribed bias member, not shown, such as a pressure spring, etc., is connected to the other end of the pressing lever 51.

Hence, with such a configuration, the pressing lever 51 swings around the supporting shaft 51*a* regarding it as a rotational center. Thus, the pressing roller 31 presses against the fixing belt 21 and forms a desired nip on the fixing belt 21 during a normal fixing operation. By contrast, the pressing roller 31 secedes from the fixing belt 21 by operation of an eccentric cam lever or the like, not shown, during operation other than the normal fixing operation, such as a sheet jam recovery process, etc. Otherwise, the pressing roller 31 decreases tension of the fixing belt 21.

Now, ordinary image forming operation executed by the thus configured above-described fixing unit 20 is briefly described herein below. When a power switch provided in the image forming apparatus main body 1 is turned on, driving rotation of the pressing roller 31 is initiated in a direction as indicated by arrow in FIG. 2, and accordingly the heater 25 is supplied with power.

The fixing belt 21 is also driven and rotated by friction force caused by the pressing roller 31 between the fixing belt 21 and the pressing roller 31 in a direction as indicated by arrow in FIG. 2. Then, a recording medium P is fed from the sheet feeding unit 12 and bears an unfixed color image on the recording medium P (i.e., an unfixed color image has been transferred) at a location of the secondary transfer roller 89 as shown in FIG. 1.

The recording medium P thus bearing the unfixed image T (i.e., a toner image) is further transported in a direction as indicated by arrow Y10 being guided by a guide plate, not shown, as shown in FIG. 2. The recording medium P subsequently enters an inlet of the nip formed between the pressing roller 31 and the fixing belt 21 presently in a contact state under pressure. Further, the toner image on the surface of the recording medium P is subsequently fused and fixed by heat provided from the fixing belt 21, which is heated by the heat transfer member 22 (heated by the heater 25), and pressure generated by both the securing member 26 reinforced by the reinforcing member 23 and the pressing roller 31 between the securing member 26 and the pressing roller 31. Then, the recording medium P is ejected from the nip and is further conveyed in a direction as indicated by arrow 11Y.

Figure 3:
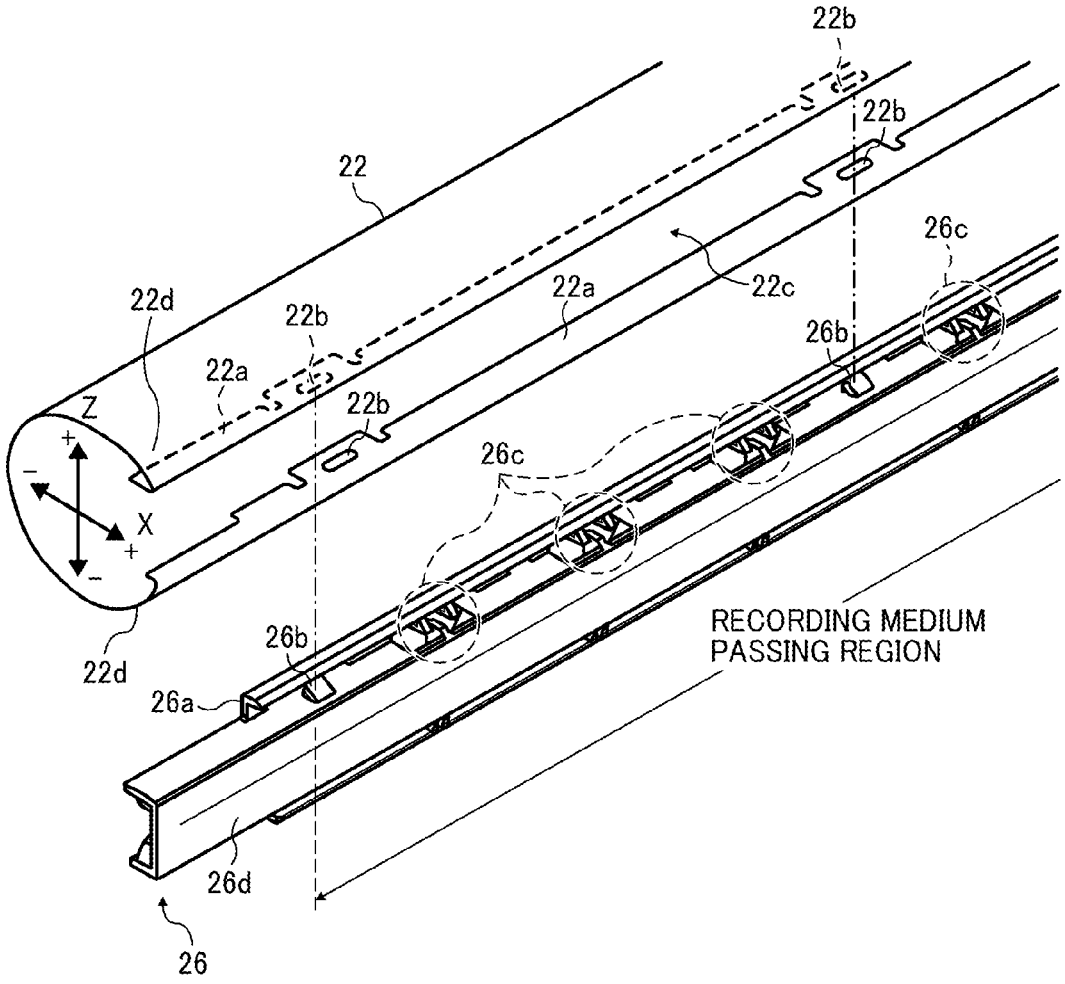
FIG. 3 is a perspective view illustrating exemplary configurations of a securing member and a heat transfer member according to one embodiment of the present invention.

Now, a shape and the structure of each of the securing member 26 and the heat transfer member 22 provided in the fixing unit 20 according to one embodiment of the present invention are now described more in detail with reference to FIG. 3 that illustrates a perspective view of these members 22 and 26.

Specifically, the heat transfer member 22 is a pipe like member having a partial opening 22*c* on its surface extending over the recording medium in its widthwise direction almost having a C-shaped cross section as shown in FIG. 3. Therefore, the heat transfer member 22 by itself is easily elastically deformable (flexible) so that the shape of the opening 22*c* is unstable (i.e., variable).

In the opening 22*c* of the heat transfer member 22, a pair of bending portions 22*a* is formed at two positions of upstream and downstream sides of the nip in a transporting direction of the recording medium P. Thus, since the heat transfer member 22 is made of thin-walled elastically deformable metal having flexibility with excellent heat conductivity, such as SUS (i.e., stainless steel) etc., as described above, the pair of bending portions 22*a* transform within its elastically deformable region (i.e., an elastic region) in both of directions X and Z when the heat transfer member 22 is used alone as shown in FIG. 3. In other words, since there is no device to suppress widening deformation of the opening 22*c* with the almost C-shaped cross section, the opening 22*c* is likely unavoidably further opened and closed.

Therefore, in this embodiment of the fixing unit 20, the securing member 26 is provided to suppress deformation of the opening 22 of the heat transfer member 22 by fitting into the opening 22*c* of the heat transfer member 22. Further, a pair of fitting connectors each having a prescribed different latch shape is provided in the heat transfer member 22 and the securing member 26, respectively, to fit to each other at the opening 22*c* of the heat transfer member 22. Thus, by fitting both sides to each other via the pair of fitting connectors, deformation of the opening 22*c* of the heat transfer member 22 can be likely suppressed. In particular, a positional relation between the heat transfer member 22 and the securing member 26 is fixed and stabilized near the securing member 26. In this embodiment, the pair of fitting connectors is formed from an angular hole 22*b* formed as an aperture in each of the pair of bending portions 22*a* of the heat transfer member 22 and a protrusion 26*b* formed at each of ends of the securing member 26 as detailed later. Here, the shape of each of the aperture (22*b*) and the protrusion 26*b* is not particularly limited to the above-described example, and an optional shape can be employed as far as it can fit to each other.

Further, according to this embodiment, three angular holes are formed in the widthwise direction of the recording medium P on each of these two bending portions 22*a* (i.e., totally six holes) formed in the upstream and downstream sides of the heat transfer member 22. However, since a right side half is partially omitted for the simplicity, only four angular holes 22*b* are indicated at four positions, respectively, in FIG. 3.

The angular holes 22*b* are located at a center and near the ends of the recording medium P in a widthwise direction of a transportation area for the recording medium P (i.e., a passage region of the recording medium P), and are thus mated with (i.e., fit to) the protrusion 26*b* correspondingly located on the securing member 26.

As described above, the securing member 26 is firmly held by the reinforcing member 23. Thus, when both of the angular hole 22*b* and the protrusion 26*b* fit to each other, displacement of the bending portions 22*a* toward the positive side in the direction X is restricted thereby almost preventing the bending portions 22*a* from deviating from the securing member 26.

Further, when the heat transfer member 22 and the securing member 26 are assembled, displacement of the bending portions 22*a* toward the negative side in the direction X is restricted by an effect that a tip of one of the bending portions 22*a* collides with a striking surface 26*a* formed in the securing member 26. Whereas, displacement of the bending portions 22*a* in the positive and negative sides in the direction Z is restricted by an effect that one of the bending portions 22*a* of the heat transfer member 22 enters a gap formed in a pinching section 26*c* formed in the securing member 26 and is pinched by the pinching section 26*c*.

Hence, since each of the bending portions 22*a* is fixed at the prescribed position in both the directions X and Z in this way, the nip formation surface 26*d* of the securing member 26 and the vicinities of the nip entrance sections 22*d* of the heat transfer member 22 are accurately positioned to each other.

In this embodiment, in order to suppress missing of the central part of the heat transfer member 22 and thereby entirely maintaining an appropriate position of the heat transfer member 22 over the passage region of the recording medium P, three latching sections are provided at three locations of the central and almost the widthwise ends of the sheet passage region, respectively. With this, a predetermined positional relation can be uniformly maintained in the widthwise direction of the fixing belt 21 over the sheet passage region.

However, the latching section can be provided at least at one place among a conveyance area of the recording medium P. In such a situation, i.e., when it is provided only at one place, the latching section is preferably set at the center (i.e., a position on the centerline) in the conveyance area of the recording medium P. Because, with this, omission of the heat transfer member 22 from the securing member 26 at the widthwise center of the fixing belt 21, at which the heat transfer member 22 is readily omitted from the securing member 26, can be effectively suppressed.

In any way, when multiple latching sections are provided at multiple places, respectively, securing force can be enhanced, and accordingly, securing of the bending portions 22*a* of the heat transfer member 22 can more preferably be stabilized.

Further, when latching sections are positioned in both downstream and upstream sides in the conveyance direction of the recording medium P (i.e., both of the bending portions 22*a* of the heat transfer member 22), both of the vicinities of the entrances of the heat transfer member 22 at the nip are fixed so that movement of the fixing belt 21 can be stabilized at both of the upstream and downstream of the nip. As a result, a rushing posture of the recording medium P rushing into the nip can be stabilized on the upstream side of the nip, while separation performance of the recording medium P can be ensured on the downstream side of the nip.

Further, the latching section is placed on a side plane almost adjacent to a sliding surface defined between the securing member 26 and the fixing belt 21 to determine positioning of the securing member 26 and the heat transfer member 22 in the vicinity of the nip formation surface as closer as possible. Therefore, a positional relation between both of the members 26 and 22 can be more accurately determined.

Now, a sequence of an assembly process of assembling the securing member 22 and the heat transfer member 22 is herein below described with reference to FIGS. 4A to 4C. First, the securing member 26 is inserted from one side end of the heat transfer member 22 in a widthwise direction of the recording medium P, so that the securing member 26 can be installed in an inner space of the heat transfer member 22 as shown in FIG. 4A.

Figure 4A:
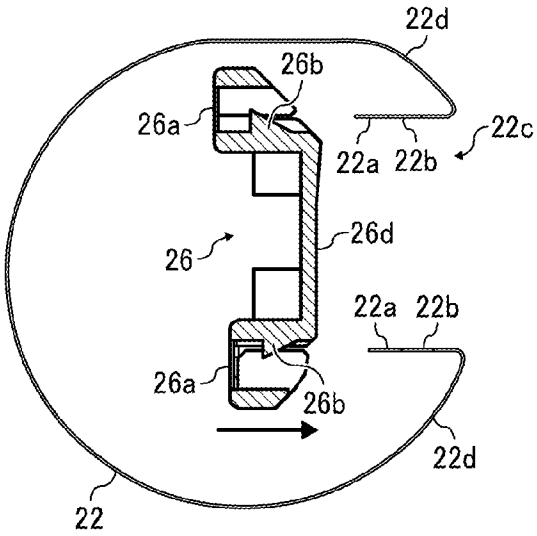
FIGS. 4A, 4B, and 4C are diagrams collectively illustrating an exemplary assembly process of assembling the securing member and the heat transfer member according to one embodiment of the present invention.

When the securing member 26 is displaced from the state as shown in FIG. 4A in a direction as indicated by arrow in FIG. 4 B, each of the bending portions 22*a* of the heat transfer member 22 elastically deforms from its tip along an inclination of the protrusion 26*b* of the securing member 26 and is widened vertically as shown in the drawing.

Figure 4B:
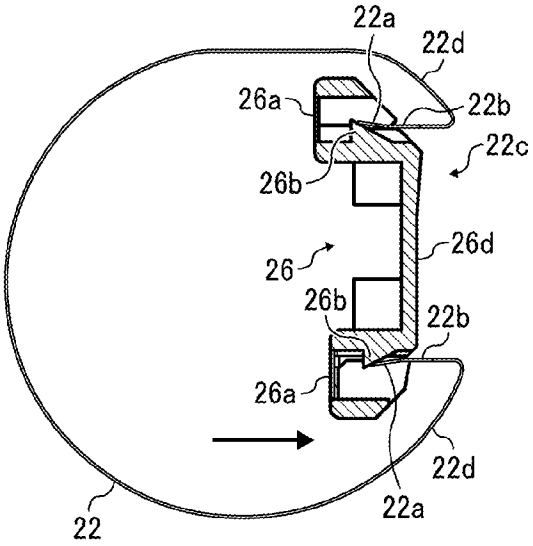

Subsequently, when the securing member 26 is further displaced from the state as shown in FIG. 4B in the direction as indicated by arrow in FIG. 4C, each of the bending portions 22*a* of the heat transfer member 22 climbs over the protrusion 26*b*. At this moment, each of the bending portions 22*a* returns from the deformed states, and each of the angular holes 22*b* provided in the bending portions 22*a* fits to the corresponding protrusion 26*b* and enters a state as shown in the drawing. Thus, each of the bending portions 22*a* functions as a retainer, so that the heat transfer member 22 and the securing member can be tightly assembled together.

According to this embodiment, the heat transfer member 22 is elastically deformable (i.e., flexible) thin wall made of metal (e.g., stainless steel) having excellent thermal conductivity. However, instead of that, the securing member 26 (including the protrusion 26*b* may be made of material having excellent elastic resilience so that the protrusion 26*b* can elastically deform and return from the deformed state to put the heat transfer member 22 into the securing member 26.

In this way, to assemble the securing member 26 and the heat transfer member 22, a fitting structure, such as snap-fit, etc., is employed so that one of the securing member 26 and the heat transfer member 22 can be bent by external force. Hence, a mutual positional relation (between the securing member 26 and the heat transfer member 22) can be established by a simple configuration without a particular securing member, such as a screw, etc. Further, by adopting a structure of the snap-fit, it can be determination based on feeling and/or sound caused by the aforementioned unique structure if assembly of the heat transfer member 22 and the securing member 26 is appropriately completed. Consequently, defective assembly can be almost prevented.

Figure 4C:
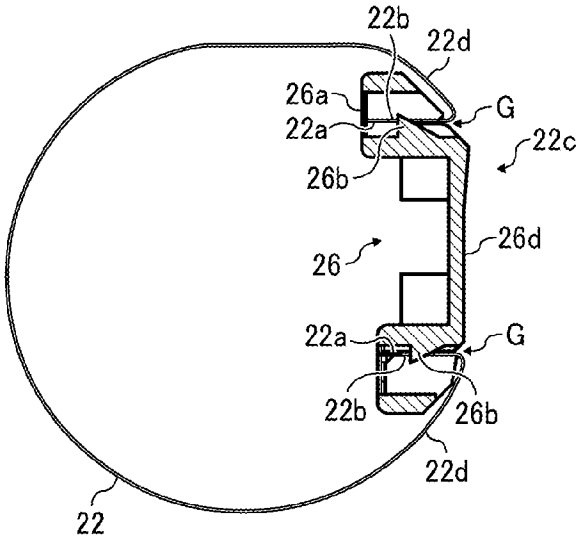

Further, as shown in FIG. 4C, since almost none of a notch, a hole, and a gap are exposed from a front surface of the heat transfer member 22 and the securing member 26 as well, except for a very small gap G, a sliding surface, i.e., the outer circumferential surface 22d of the heat transfer member 22 and the nip formation surface 26*d* each sliding on the inner circumference of the fixing belt 21 may be coated with liquid lubricant, such as fluorine grease, silicone oil, etc. Because viscosity of the liquid lubricant is generally low and sliding load generated between the fixing belt 21 and such an inner member (i.e., the heat transfer member 22 and the securing member 26) can be likely reduced (i.e., torque may decrease) when these members are coated with the liquid lubricant. As a result, the fixing unit 20 can prolong its life while possibly downsizing a driving motor, not shown, (for driving the fixing unit 20) ultimately.

Figure 5:
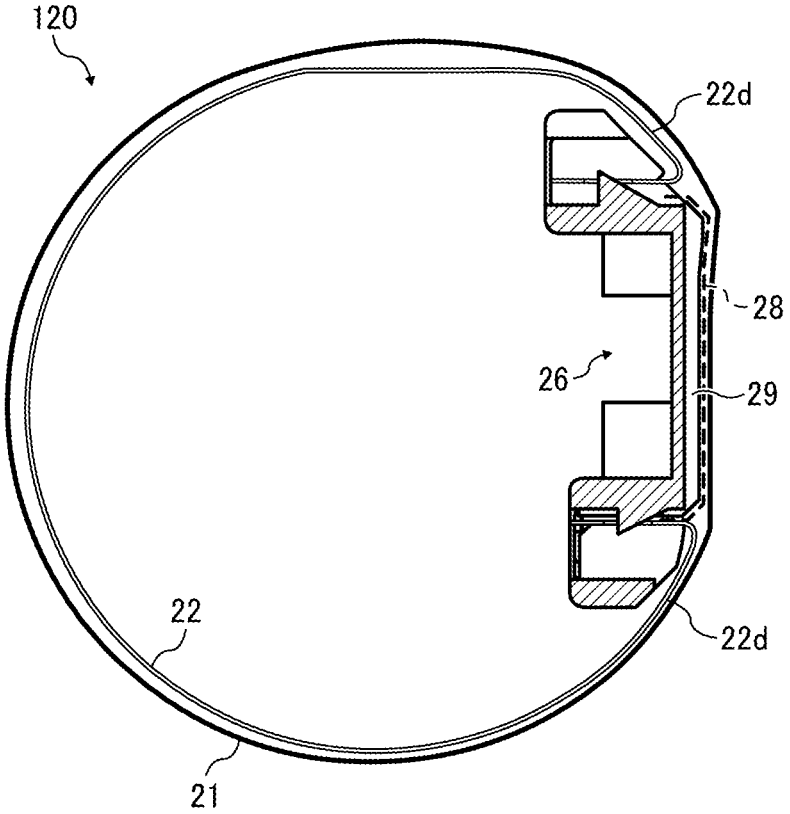
FIG. 5 is a cross-sectional view illustrating an exemplary configuration of the fixing unit according to another embodiment of the present invention.

Now, another embodiment of the fixing unit 120 is described with reference to FIG. 5. As shown there, a sheet-like sliding member (i. e., a friction reduction member) is preferably disposed between the securing member 26 and the fixing belt 21 to reduce frictional resistance caused between the securing member 26 and the fixing belt 21. As the sliding member 28, a sheet made of excellent wear and heat-resistant material with a small coefficient of friction, for example, a porous fluororesin sheet can be used. With such a sliding member 28, since sliding load can be likely reduced, the securing member 26 and the fixing belt 21 can promote respective longevities.

Further, a sliding surface between the fixing belt 21 and the sliding member 28 is preferably coated with lubricant as well. Because, when the surface of the porous sheet like sliding member 28 is coated with the lubricant, the lubricant can be retained in a perforated portion included in the sheet like sliding member 28 and accordingly, wear of the sliding member 28 can be almost prevented. Further, since the lubricant spreads the overall region between the fixing belt 21 and the heat transfer member 22 as the fixing belt 21 circulates, wearing of the fixing belt 21 can be again likely suppressed even when the heat transfer member 22 slides on the fixing belt 21 with friction.

Further, either in addition or instead of the sliding member 28, an elastic member 29 made of prescribed material, such as fluorine rubber, etc., can also be preferably placed on the surface of the securing member 26. Because, for example, when a recording medium P with low smoothness (i.e., a relatively rough recording medium P) is used and a toner image is fixed onto the recording medium P, a surface of the toner image generally becomes uneven and remains on the recording medium P due to such roughness of the recording medium P, so that a recessed portion of the toner image looks black due to diffusion of light thereby likely deteriorating image quality with a look of uneven gloss. Then, by placing the elastic member 29 on the surface of the securing member 26, the toner image is enabled to follow fibers of the recording medium P and uniformly heated. As a result, fine gloss irregularity of the toner image can be likely reduced while upgrading the image quality.

As explained heretofore, according to one aspect of the present invention, the securing member 26 and the heat transfer member 22 of the fixing unit 20 can be constantly assembled keeping a desired positional relation between the securing member 26 and the heat transfer member 22 with a simple structure at low cost.

More specifically, according to one embodiment of the present invention, a securing member and a heat transfer member can be constantly or precisely assembled establishing a desired positional relation between the securing member 26 and the heat transfer member 22, thereby enabling the belt to appropriately move both on downstream and upstream sides of the securing member to be able to precisely transport the recording medium. Because, such a fixing unit comprises an endless belt accommodating a heat source inside a loop formed by the endless belt, a rotary pressing member rotating in contact with the endless belt (e.g., in a pressure contact section), and a heat transfer member secured (e.g., to a side plate) within the loop of the endless belt to support and heat the endless belt with heat conducted from the heat source. The heat transfer member has an opening opposite the rotary pressing member. A securing member is disposed in the opening of the heat transfer member in pressure contact with the rotary pressing member via the endless belt. The heat transfer member and the securing member collectively include a pair of latching parts to firmly connect the heat transfer member and the securing member with each other when one of the latching parts is fitted to the other one of the latching parts.

In another aspect, one of the latching parts provided in one of the heat transfer member and the securing member partially elastically deforms upon receiving external force when the heat transfer member and the securing member are assembled, the one of the latching parts elastically return from the deformed states when a prescribed positional relation between the heat transfer member and the securing member is established and fits to the other one of the latching parts. In yet another aspect, one of the latching parts is provided in the heat transfer member and the heat transfer member includes a hole opposite the securing member. The other one of the latching parts is provided in the securing member and the securing member includes a protrusion to fit into the hole. In yet another aspect, a pair of latching parts is placed on the heat transfer member and the securing member at least at a widthwise center of the endless belt. In yet another aspect, multiple pairs of latching parts are placed at prescribed plural positions on the heat transfer member and the securing member in the widthwise direction of the endless belt, respectively. In yet another aspect, multiple pairs of latching parts are placed at prescribed three different positions on the heat transfer member and the securing member in the widthwise direction of the endless belt. The prescribed three different positions are a center and both ends of the region through which the recording medium passes.

According to another aspect of the present invention, movement of the fixing belt of the fixing unit can be appropriately controlled both at downstream and upstream sides of the nip, and the fixing unit can stabilize transportation of the recording medium P through the nip. That is, in yet another aspect, a pair of latching parts is placed on each of upstream and downstream sides of the heat transfer member and the securing member in a conveying direction of the recording medium. Further, in yet another aspect, an outer circumferential surface extending over the heat transfer member and the securing member is continuous at a part facing an inner circumferential surface of the endless belt to inhibit liquid from permeating through the part. In yet another aspect, the securing member includes a friction-reducing member and an elastic member in a region sliding contact with the endless belt.

According to yet another aspect of the present invention, an image forming apparatus can stabilize transportation of the recording medium P in a fixing unit when the fixing unit with the above-described configuration is employed in the image forming apparatus. Because, to form a toner image on a recording medium the image forming apparatus includes a toner image forming unit to prepare the toner image on the recording medium and the above-described fixing unit to fix the toner image onto the recording medium.

According to yet another aspect of the present invention, a fixing unit composed of a securing member and a heat transfer member can be efficiently manufactured. That is, to assemble a fixing unit composed of an endless belt accommodating a heat source inside a loop formed by the endless belt, a rotary pressing member rotating in contact with the endless belt in a pressure contact section, a heat transfer member having an opening and secured to a side plate within the loop of the endless belt to support and heat the endless belt with heat conducted from the heat source, and a securing member disposed in the opening of the heat transfer member in pressure contact with the rotary pressing member via the endless belt, a method of assembling the fixing unit includes the steps of inserting the securing member into the heat transfer member in an axial direction of the heat transfer member from one end of the heat transfer member, displacing the securing member toward the opening of the heat transfer member to contact the rotary pressing member via the endless belt within the heat transfer member, fitting a first latching parts provided in one of the heat transfer member and the securing member to a second latching parts provided in the other one of the heat transfer member and the securing member, and firmly connecting the heat transfer member and the securing member with each other by confirming completion of connection of the first and second latching parts by the sense of touch or hearing.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various embodiments and can be appropriately changed.

What is claimed is:

1. A fixing unit for fixing an unfixed toner image onto a recording medium by applying a pressing and heating process to the unfixed toner image, the fixing unit comprising:

an endless belt accommodating a heat source inside a loop formed by the endless belt;

a rotary pressing member rotating in contact with the endless belt in a pressure contact section;

a heat transfer member secured to a side plate within the loop of the endless belt to support and heat the endless belt with heat conducted from the heat source, the heat transfer member having an opening opposite the rotary pressing member;

a securing member disposed in the opening of the heat transfer member in pressure contact with the rotary pressing member via the endless belt; and at least a pair of latching parts disposed in the heat transfer member and the securing member to firmly connect the heat transfer member and the securing member with each other when one of the latching parts fits to the other one of the latching parts, wherein the heat transfer member includes a bending portion at each end thereof in a circumferential direction of the endless belt, and wherein the securing member includes a recess surrounding a tip of the bending portion of the heat transfer member, the recess including an opening disposed opposite and facing the rotary pressing member.

2. The fixing unit as claimed in claim 1, wherein the one of the latching parts of the one or more pairs of latching parts provided in one of the heat transfer member and the securing member partially elastically deforms upon receiving external force when the heat transfer member and the securing member are assembled, the one of the latching parts of the one or more pairs of latching parts elastically returns from the deformed state when a prescribed positional relation between the heat transfer member and the securing member is established and fits to the other one of the latching parts of the one or more pairs of latching parts.

3. The fixing unit as claimed in claim 1, wherein the one of the latching parts of the one or more pairs of latching parts provided in the heat transfer member includes a hole opposite the securing member, and wherein the other one of the latching parts of the one or more pairs of latching parts provided in the securing member includes a protrusion to fit into the hole.

4. The fixing unit as claimed in claim 1, wherein one pair of the at least a pair of latching parts is placed on the heat transfer member and the securing member at a widthwise center of the endless belt.

5. The fixing unit as claimed in claim 1, wherein at least two pairs of latching parts are placed at prescribed two different positions on the heat transfer member and the securing member in the widthwise direction of the endless belt, respectively.

6. The fixing unit as claimed in claim 1, wherein three pairs of latching parts are placed at prescribed three different positions on the heat transfer member and the securing member in the widthwise direction of the endless belt, respectively, the prescribed three different positions being a center and both ends of a region of the fixing unit through which the recording medium passes.

7. The fixing unit as claimed in claim 1, wherein at least two pairs of latching parts are placed on the heat transfer member and the securing member at both upstream and downstream sides of the opening of the heat transfer member in a conveying direction of the recording medium, respectively.

8. The fixing unit as claimed in claim 1, wherein an outer circumferential surface extending over the heat transfer member and the securing member is continuous at a part facing an inner circumferential surface of the endless belt to inhibit liquid from permeating through the part.

9. The fixing unit as claimed in claim 1, wherein the securing member includes at least one of a friction reducing member and an elastic member in a region of the securing member in sliding contact with the endless belt.

10. An image forming apparatus to form a toner image on a recording medium, comprising:

a toner image forming unit to form a toner image on a recording medium; and a fixing unit to fix the toner image onto the recording medium, the fixing unit including;

an endless belt accommodating a heat source inside a loop formed by the endless belt, a rotary pressing member rotating in contact with the endless belt in a pressure contact section, a heat transfer member secured to a side plate within the loop of the endless belt to support and heat the endless belt with heat conducted from the heat source, the heat transfer member having an opening opposite the rotary pressing member, and a securing member disposed in the opening of the heat transfer member in pressure contact with the rotary pressing member via the endless belt, and at least a pair of latching parts disposed in the heat transfer member and the securing member to firmly connect the heat transfer member and the securing member with each other when one of the latching parts of the at least a pair of latching parts is fitted to the other one of the latching parts of the at least a pair of latching parts, wherein the heat transfer member includes a bending portion at each end thereof in a circumferential direction of the endless belt, and wherein the securing member includes a recess surrounding a tip of the bending portion of the heat transfer member, the recess including an opening disposed opposite and facing the rotary pressing member.

11. The image forming apparatus as claimed in claim 10, wherein the one of the latching parts of the one or more pairs of latching parts provided in one of the heat transfer member and the securing member partially elastically deforms upon receiving external force when the heat transfer member and the securing member are assembled, the one of the latching parts of the one or more pairs of latching parts elastically returns from the deformed state when a prescribed positional relation between the heat transfer member and the securing member is established and fits to the other one of the latching parts of the one or more pairs of latching parts.

12. The image forming apparatus as claimed in claim 10, wherein the one of the latching parts of the one or more pairs of latching parts is provided in the heat transfer member including a hole opposite the securing member, and wherein the other one of the latching parts of the one or more pairs of latching parts is provided in the securing member including a protrusion to fit into the hole.

13. The image forming apparatus as claimed in claim 10, wherein one pair of the at least a pair of latching parts is placed on the heat transfer member and the securing member at a widthwise center of the endless belt.

14. The image forming apparatus as claimed in claim 10, wherein at least two pairs of latching parts are placed at prescribed two different positions on the heat transfer member and the securing member in the widthwise direction of the endless belt, respectively.

15. The image forming apparatus as claimed in claim 10, wherein three pairs of latching parts are placed at prescribed three different positions on the heat transfer member and the securing member in the widthwise direction of the endless belt, respectively, the prescribed three different positions being a center and both ends of a region of the fixing unit through which the recording medium passes.

16. The image forming apparatus as claimed in claim 10, wherein at least two pairs of latching parts are placed on the heat transfer member and the securing member at both upstream and downstream sides of the opening of the heat transfer member in a conveying direction of the recording medium, respectively.

17. The image forming apparatus as claimed in claim 10, wherein an outer circumferential surface extending over the heat transfer member and the securing member is continuous at a part facing an inner circumferential surface of the endless belt to inhibit liquid from permeating through the part.

18. The image forming apparatus as claimed in claim 10, wherein the securing member includes at least one of a friction reducing member and an elastic member in a region of the securing member in sliding contact with the endless belt.

19. A method of assembling a fixing unit including an endless belt accommodating a heat source inside a loop formed by the endless belt, a rotary pressing member rotating in contact with the endless belt in a pressure contact section, a heat transfer member secured to a side plate within the loop of the endless belt to support and heat the endless belt with heat conducted from the heat source, the heat transfer member having an opening opposite the rotary pressing member, and a securing member disposed in the opening of the heat transfer member in pressure contact with the rotary pressing member via the endless belt, the method comprising the steps of:

inserting the securing member into the heat transfer member in an axial direction of the heat transfer member from one end of the heat transfer member;

displacing the securing member toward the opening of the heat transfer member to contact the rotary pressing member via the endless belt within the heat transfer member;

fitting first latching parts provided in one of the heat transfer member and the securing member to second latching parts provided in the other one of the heat transfer member and the securing member; and firmly connecting the heat transfer member and the securing member with each other by confirming completion of connection of the first and second latching parts by the sense of touch or hearing, wherein the heat transfer member includes a bending portion at each end thereof in a circumferential direction of the endless belt, and wherein the securing member includes a recess surrounding a tip of the bending portion of the heat transfer member, the recess including an opening disposed opposite and facing the rotary pressing member.

20. The method as claimed in claim 19, wherein one of the latching parts provided in one of the heat transfer member and the securing member partially elastically deforms upon receiving external force when the heat transfer member and the securing member are assembled, the one of the latching parts elastically returns from the deformed state when a prescribed positional relation between the heat transfer member and the securing member is established and fits to the other one of the latching parts, wherein one of the latching parts includes a hole opposite the securing member and the other one of the latching parts includes a protrusion to fit into the hole.

21. The image forming apparatus as claimed in claim 1, wherein the securing member includes a striking surface to collide the tip of the bending portion of the heat transfer member and disposed on a bottom of the recess of the securing member.

22. The image forming apparatus as claimed in claim 21, wherein the at least a pair of the latching parts include a protrusion mounted on a first inner face of the recess of the securing member other than the striking surface and fitted to the bending portion.

23. The image forming apparatus as claimed in claim 22, wherein the securing member includes a pinching section mounted on a second inner face of the recess of the securing member other than the striking surface.

24. A fixing unit for fixing an unfixed toner image onto a recording medium by applying a pressing and heating process to the unfixed toner image, the fixing unit comprising:

an endless belt accommodating a heat source inside a loop formed by the endless belt;

a rotary pressing member rotating in contact with the endless belt in a pressure contact section;

a heat transfer member secured to a side plate within the loop of the endless belt to support and heat the endless belt with heat conducted from the heat source, the heat transfer member having an opening opposite the rotary pressing member;

a securing member disposed in the opening of the heat transfer member in pressure contact with the rotary pressing member via the endless belt; and at least a pair of latching parts disposed in the heat transfer member and the securing member to firmly connect the heat transfer member and the securing member with each other when one of the latching parts fits to the other one of the latching parts, wherein the heat transfer member includes a bending portion at each end thereof in a circumferential direction of the endless belt, wherein the securing member includes a striking surface to collide and hold a tip of the bending portion of the heat transfer member, and wherein the securing member includes separately formed recesses at each end of the securing member such that a corresponding end tip of the bending portion of the heat transfer member is inserted into the corresponding recess, each recess including an opening disposed oppositely facing the rotary pressing member.

* * * * *